United States Patent [19]

Caillier

[11] Patent Number: 4,860,831

[45] Date of Patent: Aug. 29, 1989

[54] WELL APPARATUSES AND METHODS

[76] Inventor: Michael J. Caillier, 261 Rees St., Breaux Bridge, La. 70517

[21] Appl. No.: 908,188

[22] Filed: Sep. 17, 1986

[51] Int. Cl.[4] ..... E21B 43/08

[52] U.S. Cl. ..... 166/384; 166/158; 166/236; 166/278; 166/387

[58] Field of Search ..... 166/384, 385, 386, 387, 166/77, 236, 51, 313, 278, 157, 158

[56] References Cited

U.S. PATENT DOCUMENTS

| | | | |
|---|---|---|---|
| 50,967 | 11/1865 | St. John . | |
| 58,953 | 10/1866 | Osgood . | |
| 83,901 | 11/1868 | Armstrong . | |
| 963,549 | 7/1910 | Harmon . | |
| 1,974,664 | 9/1934 | Patten | 255/61 |
| 2,216,037 | 9/1940 | Layne | 166/1 |
| 2,321,318 | 6/1943 | Reistle | 166/5 |
| 2,356,769 | 8/1944 | Layne | 166/26 |
| 2,513,944 | 7/1950 | Kessler | 166/1 |
| 3,145,778 | 8/1964 | Grekel | 166/157 |
| 3,362,475 | 1/1968 | Huitt | 166/20 |
| 3,587,740 | 6/1971 | Gerwick | 166/278 |
| 3,791,447 | 2/1974 | Smith et al. | 166/311 |
| 4,549,608 | 10/1985 | Stowe | 166/280 |
| 4,550,778 | 11/1985 | Sullivan | 166/234 |
| 4,552,215 | 11/1985 | Almond | 166/278 |
| 4,552,216 | 11/1985 | Wilson | 166/261 |
| 4,553,595 | 11/1985 | Huang | 166/278 |
| 4,606,408 | 8/1986 | Zunkel | 166/278 |
| 4,627,496 | 12/1986 | Ashford et al. | 166/292 |
| 4,681,163 | 7/1987 | Guidry et al. | 166/51 |
| 4,682,657 | 7/1987 | Crawford | 166/77 |
| 4,694,901 | 9/1987 | Skinner | 166/77 |

OTHER PUBLICATIONS

N-Situ Technology, Section 3, Baker Sand Control, 1984–1985 Catalog, pp. 23–50, 55–56.

Introduction to Oil Well Service and Workover, published by the University of Texas, p. 23, 1971.

Workover Well Control, by Adams, pp. 4–11.

Well Improvement Specialists B. K. Series, Double Walled Sand Filter.

Rebound, Composite Catalog of Oil Field Equipment and Service, 37th Revision 1986–1987 in 4 volumes, Coiled Tubing Units.

Bowen, Composite Catalog of Oil Field Equipment and Service, 37th Revision 1986–1987 in 4 volumes, Bowen Continuous String Coiled Tubing Units.

Halliburton Services Sales and Service Catalog, 1970–1971, pp. 130–136.

Casing Hardware and Oilfield Service Tools, Dowell, 1982–1983 Composite Catalog, pp. 2520–2523.

*Primary Examiner*—Stephen J. Novosad

*Assistant Examiner*—Terry Lee Melius

[57] ABSTRACT

Device combinations and methods for wellbore operations for simplifying production methods and workover operations and for production from a failed secondary zone. Using a commercially available prior art coil tubing unit, a coil tubing string is run into an already-in-place production tubing string. The coil tubing string has a commercially available prior art sand control device at the bottom, a portion of blank pipe and a commercially available prior art releasable hydraulic running and release tool ("hrart"). A commercially available prior art small washpipe is connected to the hrart. Wash fluid flows through the hrart, to the wash pipe, and then out of the washpipe thereby washing the sand control device into place in filter media at the perforated production zone. An isolation packer or packers are set between the production tubing and coil tubing string. The coil tubing string and the upper portion of the running tool with the washpipe attached to it are then disconnected from the remainder of the hrart and removed so that production can begin. Use of a commercially available prior art prepacked double screen sand control filter assembly at the bottom of the coil tubing string partially or wholly encases or isolates the washpipe from formation sands and from solids in the fluids in the wellbore, thereby reducing or eliminating the problems associated with washpipes stuck in screen assemblies. When a secondary production zone has failed, a system according to the present invention can be washed into place through the production tubing into filter media placed at the secondary zone level and new production can be commenced without the need for an expensive and time-consuming fishing operation. To abandon one zone and produce from another using a typical workover procedure can cost as much as ten times more than the use of the system of the present invention.

5 Claims, 4 Drawing Sheets

WELL APPARATUSES AND METHODS

BACKGROUND OF THE INVENTION

1. Field of the Invention

This invention is directed to apparatuses and methods for wellbore operations and to installation and production apparatuses and methods.

2. Description of the Prior Art

Often deficiencies occur in producing oil and gas wells, either because of problems with the various production mechanisms or because of depletion of the natural resources produced from the well. The processes, methods, and equipment used to return deficient wells to production are referred to as "workover" services and "workover" rigs.

In a typical problem situation, a well which has "sanded up" (i.e., sand has infiltrated the production zone and production tubing) and is off production must be repaired so that production can be resumed. The workover of such a well can include the following:

1. Workover rig is moved to location and prepared for work.
2. Blowout preventers are installed.
3. Production tubing present in the well is removed.
4. A working string is run into the hole and sand is washed from the well.
5. Working string is removed from the hole.
6. A bridge plug is set above original perforations and production zone to seal them off.
7. Casing is tested for leaks and repaired if necessary.
8. Casing is perforated above bridge plug and perforations are washed.
9. New production zone is gravel packed.
10. Production tubing is run into the hole and production packer is set.
11. Blowout preventer is removed, production tree is installed and workover rig is removed. Such a workover procedure is complex, expensive, and time-consuming.

In the typical method used to produce a well (whether it is deficient or not) complex and expensive steps are required, including multiple trips into and out of the wellbore. For example, production of a well using a conventional through-tubing gravel pack and crossover tool requires the following:

1. Run in the string with the crossover tool and screen assembly.
2. Pump gravel pack sand through the crossover tool and around screen assembly.
3. Remove the crossover tool.
4. Use a wireline to run in a wireline pack-off and a holddown assembly to isolate a zone.

The gravel packing of a through-tubing filter assembly such as a screen device often results in the sticking of the wash pipe in the screen of the filter assembly. Both formation sands and workover fluids containing dirt or other solids can exacerbate this problem.

Wireline pack-off and hold down assemblies are complex mechanisms and they cannot be tested once they are emplaced in the wellbore. If they fail, formation sand is produced up and around the screen. This can eventually result in the sanding-up of the well and prevention or inhibition of production flow. To remedy these problems the downhole equipment and filter media must be removed from the wellbore and the installational procedure must be done again.

Once an existing production zone is sanded-up, it is typical to employ a full workover rig to remove all the in-place equipment. Such workovers are very expensive. Through-tubing gravel packing presents the problems of close tolerances for pumping through crossover tools and the sticking of wash pipes.

Coil tubing units have previously been used to wash sands out of a wellbore and to jet a well in to reduce the hydrostatic head of fluid on the formation allowing production to be commenced.

SUMMARY OF THE PRESENT INVENTION

The present invention is directed to new device combinations and methods for wellbore operations. The new device combinations and methods can be used to simplify production methods and workover operations and for production from a failed secondary zone. Using a commercially available prior art coil tubing unit, a coil tubing string is run into an already-in-place production tubing string. The coil tubing string has a commercially available prior art sand control device at the bottom, a portion of blank pipe and a commercially available prior art releasable hydraulic running and release tool ("hrart"). A commercially available prior art small washpipe is connected to the hrart. Wash fluid flows through the hrart, to the wash pipe, and then out of the washpipe thereby washing the sand control device into place in filter media at the perforated production zone. A jet shoe can be used at the bottom of the sand control device to assist in the washing-in operation. An isolation packer or packers are set between the production tubing and coil tubing string. The coil tubing string and the upper portion of the running tool with the washpipe attached to it are then disconnected from the remainder of the hrart and removed so that production can begin.

Use of a commercially available prior art prepacked double screen sand control filter assembly at the bottom of the coil tubing string partially or wholly encases or isolates the washpipe from formation sands and from solids in the fluids in the wellbore, thereby reducing or eliminating the problems associated with washpipes stuck in screen assemblies.

When a secondary production zone has failed, a system according to the present invention can be washed into place through the production tubing into filter media placed at the secondary zone level and new production can be commenced without the need for an expensive and time-consuming fishing operation. To abandon one zone and produce from another using a typical workover procedure can cost as much as ten times more than the use of the system of the present invention.

It is, therefore, an object of the present invention to provide new apparatuses and methods for well operations.

Another object of the present invention is the provision of new apparatuses and methods for producing a well and for simplifying workover operations.

Yet another object of the present invention is the provision of a system of a new combination of presently available devices and a new method for using a coil tubing unit to facilitate well production.

An additional object of the present invention is the provision of such a system and method utilizing a disengageable hydraulic running and release tool to run a washpipe within the coil tubing string to help wash the coil tubing string into place in filter media in the wellbore.

A particular object of the present invention is the provision of such a system and method employing a sand control device which can inhibit or prevent the flow of solids so that sticking of the washpipe within the sand control device is reduced or eliminated.

Another particular object of the present invention is the use of isolation packers to close off the production tubing thereby eliminating the need for wireline pack-off and hold down assemblies which cannot be tested and require multiple trips in the wellbore.

Another object is the elimination of the need for using a crossover tool.

To one of skill in this art who has the benefit of this invention's teachings, other and further objects, features and advantages will be clear from the following description of presently preferred embodiments of the invention, given for the purpose of disclosure, when taken in conjunction with the accompanying drawings.

DESCRIPTION OF PREFERRED EMBODIMENTS

Figure 1:
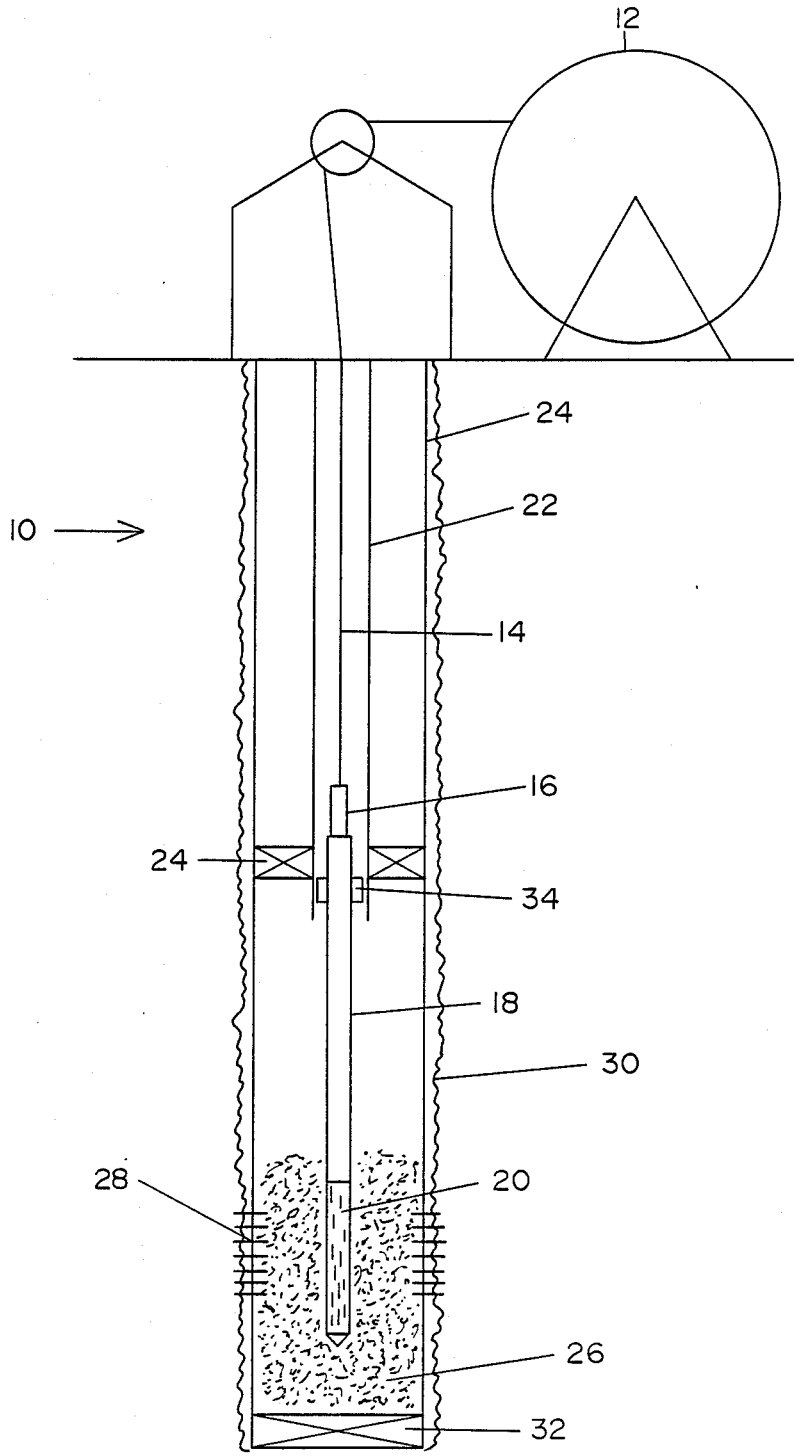
FIG. 1 is a schematic view showing a typical wellbore installation procedure with a system according to the present invention.

The system 10 as shown in FIG. 1 includes a coil tubing unit 12 from which a coil tubing string 14 extends into a casing production tubing 22 and casing 24 of a wellbore 30. A packer 24 seals off the space between the casing 24 and the production tubing 22. An hydraulic running and releasing tool ("hrart") 16 is disengageably connected to the coil tubing string 14. Beneath the hrart 16 is an isolation packer 34 in tandem with a portion of blank pipe 18 and a sand control device 20. A washpipe (not shown) is connected to the hrart and is disposed within the blank pipe and sand control device.

The coil tubing string 14 is prepared at the surface and the various mechanisms are connected to it. The string 14 is then washed into the filter media in the hole to a depth at which the sand control device 20 is in place in filter media 26 near or adjacent perforations 28 which extend through the casing 24 and wellbore 30 into the producing formation.

Figure 2:
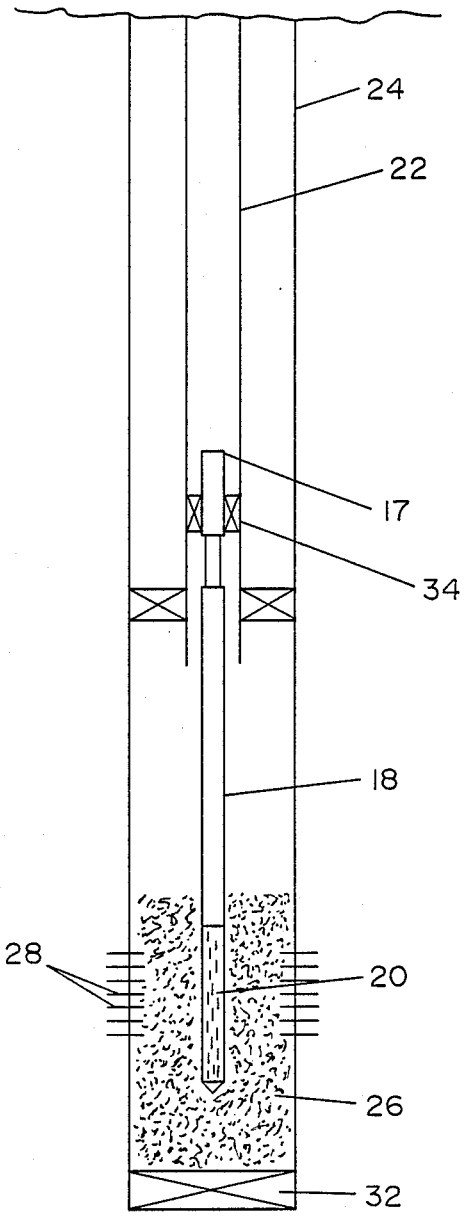
FIG. 2 is a schematic view showing the production mode of the system of FIG. 1.

As shown in FIG. 2 various mechanisms previously part of the coil tubing string 14 have been disconnected from the string, including a lower half nipple 17 of the hrart 16, the blank pipe 18 and the sand control device 20. The washpipe has been removed and an isolation packer 34 has been set so that the well can be produced through the device 20, the pipe 18 and the nipple 17.

Figure 4:
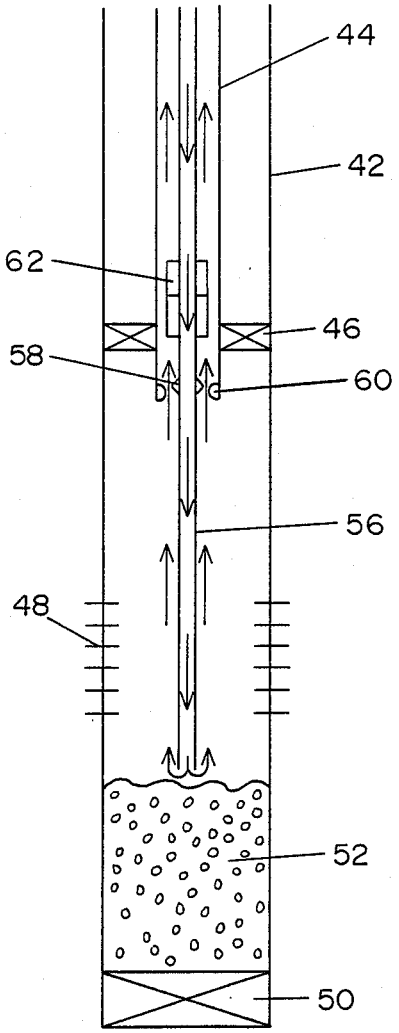
FIGS. 4–7 are schematic views showing steps in a typical wellbore procedure according to the present invention.

FIGS. 4–7 illustrate the use of a system according to the present invention for production from a cased wellbore. FIG. 4 shows the washing away of formation sand 52 from the perforations 48. This is accomplished by inserting a pipe string 56 through production tubing 44 which is within casing 42 down to the level of perforations 48. The washing fluid flows down the pipe 56 and up through the production tubing. A packer 46 between the casing 42 and production tubing 44 prevents the flow of fluid between casing and production tubing. Production fluid flows between a landing nipple 60 and locator keys 58. The pipe 56 is washed down until the locator keys 58 contact the landing nipple 60. A tandem shear pin dummy packer can be used to determine how much weight is being exerted at a particular depth so that the number of shear pins required can be placed in the isolation packer for setting above a sand control device. A PBTD ("Plug Back Total Depth") 50 closes off the bottom of the wellbore.

Figure 5:
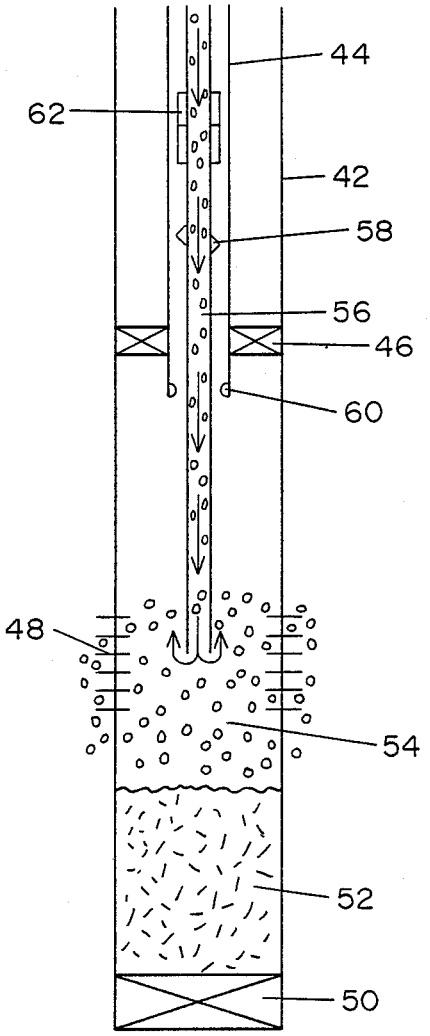

FIG. 5 illustrates the disposition of the filter media 54 in the wellbore around the producing zone. The pipe 56 is raised and the filter media 54 flows through the pipe 56 into the area near and adjacent the perforations 48. The pipe 56 is then removed from the wellbore.

The hydraulic running and releasing tool is a commercially available mechanical device which permits separation of the coil tubing and bottom hole assembly once the system is properly placed at the production interval or zone. Such tools are made by Well Improvement Specialists, Inc. of Houston, Texas, and Baker Sand Control. The preferred sand control device is the commercially available double-walled sand control device having two screening walls such as that made by and commercially available from Well Improvement Specialists, Inc. Such a device has an outer screen or slotted pipe and an inner screen. Between these two members there is filter media which inhibits the passage of formation sands into the production string. This in turn serves to inhibit or prevent the sticking of a washpipe within the string. The preferred filter media is an amount of glass or ceramic beads which are substantially spherical to enhance the washing-in of a sand control device. it is preferred that the isolation packer 54 be used rather than a pack-off so that pressure testing of the annulus between casing and tubing is possible to insure that the packer is properly set. Also a pack-off requires two additional wireline trips.

Figure 3:
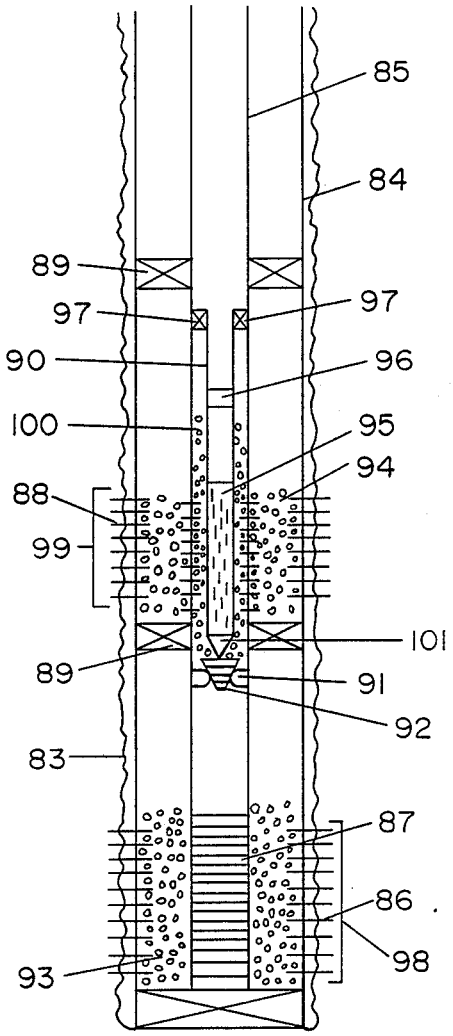
FIG. 3 is a schematic view showing treatment of a wellbore for use with a system according to the present invention.

FIG. 3 illustrates use of the system according to the present invention in a secondary production zone. A casing string 84 within a wellbore 83 has a production string 85 for producing fluid from the bottom of the wellbore 83. At the end of the production string 85 is a gravel pack screen 87 for screening fluid flowing from a (now-abandoned or to-be-abandoned) zone 98, through perforations 86 and filter media 93. To produce through another production interval 99 using the new system according to the present invention, the production string 85 is left in place and a plug 92 is set on a landing nipple 91 in the production string below the new zone of interest. Primary packers 89 seal the annulus above and below the area of interest. New perforations 88 permit flow of production fluid from the new zone of interest 99. Another amount of filter media 94 is emplaced adjacent the zone 99 and the production string 85 is perforated adjacent the zone 99. Filter media 100 has also been deposited with the production string 85.

As shown in FIG. 3 a production system according to the present invention has been washed-in within and through the production string 85. The bottom portion of the system is in place for production, including a shear pin safety joint 96, blank pipe 90, a sand control device 95 and a jet shoe 101. A through-tubing isolation packer 97 insures that only fluid flowing through the sand control device 95 is produced.

Figure 6:
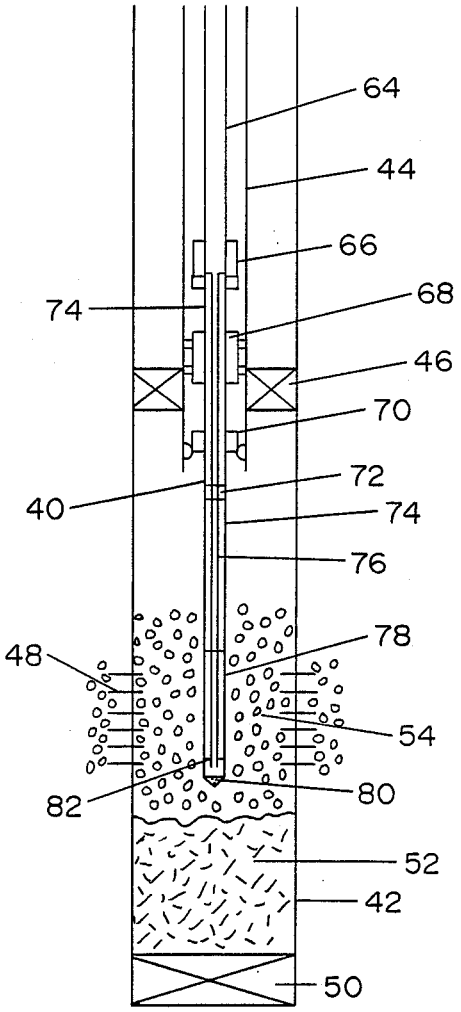

A system 40 according to the present invention is run in to the wellbore according to the method of the present invention as shown in FIG. 6. A coil tubing string 64 has connected to it an hydraulic running and releasing tool 66, blank pipe 74, a shear pin safety joint 72 between two pieces of pipe 74, a sand control device 78 and jet shoe 80. The string 64 including its attached mechanisms as described is washed into place in filter media 54 using a wash pipe 76 which is within the pipe 74 and the sand control device 78. Wash fluid pumped from above flows through the tool 66 and through the wash pipe 76. An isolation packer 68 insures that fluid will not flow between the production tubing and the exterior of the system 40.

The washing action of the washpipe 76 is provided by pumping washing fluid down the coil tubing and through the jet shoe 80 for penetration through the filter media to emplace the sand control device adjacent the production interval or zone. Use of the jet shoe 80 facilitates the washing-in of the system.

Typical production tubing is $2\frac{7}{8}$ inches in outside diameter and $2\frac{1}{2}$ inches in inside diameter. Use of production tubing 44 of these dimensions means that the tubing 64 must be smaller than $2\frac{1}{4}$ inches in outside diameter. Consequently, a very small washpipe must be used. The preferred washpipe is composed of $\frac{3}{8}$ to $\frac{1}{2}$ inch mild steel joints connected together. Washpipe seals 82 ensure that fluid goes out through the jet shoe 80 rather than around the washpipe and through the sand control device.

Use of the preferred double-walled or two screen sand control device reduces or eliminates the sticking of the washpipe 76 in the pipe 74 or in the sand control device 78.

Figure 7:
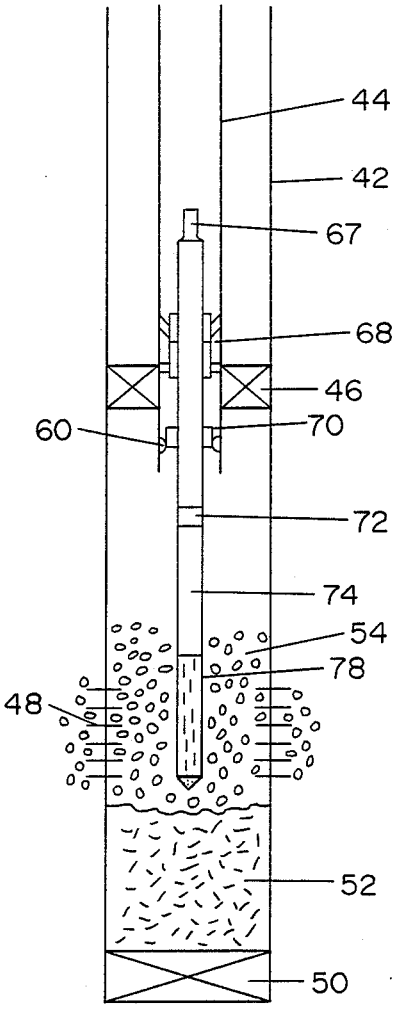

To release the top portion of the hrart 66 and washpipe, a ball is inserted in the coil tubing string 64 which, when it seats in the hrart 66, causes pressure to build up shearing pins which allow a piston to shift releasing the top portion from the lower portion. The coil tubing string 64 is then pulled out of the wellbore with the washpipe 76, leaving the bottom portion of the hrart 66, a nipple 67, the blank pipe 74, the safety joint 72, the sand control device 78, and the jet shoe 80 in place for production as shown in FIG. 7. Production fluids can now flow through the perforations 48, the filter media 54, the sand control device 78, the pipe 74, and the nipple 67 of the hrart into the production tubing 44. An isolation packer 68 insures that only those fluids passing through the sand control device 78 will flow into the production tubing 44.

The preferred coil tubing unit is a commercially available $1\frac{1}{4}$ inch pipe system. Camco Coil Tubing And Nitrogen Services, Houston, Tex., provides such a unit.

In conclusion, therefore, it is seen that the present invention and embodiments thereof disclosed herein are well-adapted to carry out the objectives and obtain the ends set forth. To one of skill in this art who has the benefit of this invention's teachings, it will be clear that certain changes can be made without departing from the spirit and scope of this invention as claimed in the following claims.

What is claimed is:

1. A method for emplacing a bottom hole assembly in a wellbore and attaching said assembly to a production string, the wellbore having an amount of filter media located therein for filtering production fluid, said wellbore further having a production string therein and a packer means within the wellbore sealing off the annulus between the production string and the wellbore or a casing within the wellbore, the bottom hole assembly being inserted through the production tubing as a part of a system which comprises (a) a length of coil tubing, (b) a hydraulic running and release tool means, (c) the bottom hole assembly which includes an isolation packer means attached to the hydraulic running and release tool means, a length of blank pipe connected to and below the isolation packer means, a sand control means connected to the blank pipe, and (d) a wash pipe means inserted into the sand control means and connected to the running and release tool means, the method including the steps of inserting the system into the production string, pumping wash fluid through the system to wash the bottom hole assembly into place in the filter media, sealing the space within the production string so that production can flow upward only through the sand control means by setting the isolation packer means, disconnecting the top portion of the hydraulic running and release tool means, and removing the disconnected portion of the hydraulic running and release tool means, the wash pipe, and the coil tubing from the wellbore.

2. The method of claim 1 wherein the sand control means is a double-screen sand control filter having two screening walls with a space therebetween and filter media within the space for further filtration of production fluid.

3. A method for emplacing a bottom hole assembly in a well adjacent to a production string in a second production zone above a first abandoned production zone, the well having the production string extending to the first abandoned production zone and primary packer means sealing off the space between the exterior of the production string and the wellbore or the casing of the wellbore, the method including plugging the production string at a location below the second production zone, perforating the primary production string adjacent the second production zone, placing filter media for filtering production fluid both exteriorly of the primary production string and interiorly thereof adjacent the second production zone, emplacing sealing means above the secondary production zone for sealing off the space between the primary production string and the wellbore casing, inserting a system including (a) a length of coil tubing, (b) a hydraulic running and release tool means, (c) the bottom hole assembly which includes an isolation packer means attached to the hydraulic running and release tool means, a length of blank pipe connection to and below the isolation packer means, a sand control means connected to the blank pipe, and (d) a wash pipe means inserted into the sand control means and connected to the running and release tool means, sealing the space within the primary production string so that production fluid can flow upward only through the sand control means, the said sealing being accomplished by emplacing and activating isolation packer means between the lower portion of the hydraulic running and release tool and the production string's interior surface, and disconnecting the top portion of the hydraulic running and release tool means.

4. Wellbore operation system inserted into production tubing for emplacing a bottom hole assembly, comprising:

coil tubing means, hydraulic running and releasing tool means connected to the coil tubing means, pipe means releasably connected to and below the tool means, isolation packer means connected to the pipe means below the tool means, blank pipe means connected to and below the isolation packer means, sand control means connected to the blank pipe means below the isolation packer means, wash pipe means connected to the tool means and disposed within the blank pipe means and the sand control means, and the entire wellbore operation system being adapted to be inserted within production tubing, wherein the bottom hole assembly is emplaced during a single trip through the production tubing.

5. The apparatus of claim 4 wherein the sand control means is a double-walled sand control filter device having two screening walls with a space therebetween and filter media within the space for further filtration of production fluid.

* * * * *